US010537772B2

(12) United States Patent
Stephens

(10) Patent No.: US 10,537,772 B2
(45) Date of Patent: Jan. 21, 2020

(54) GOLF PUTTER

(71) Applicant: Pyramid Putters, LLC, Denver, CO (US)

(72) Inventor: Matthew Stephens, Aurora, CO (US)

(73) Assignee: Pyramid Putters, LLC, Denver, CO (US)

( * ) Notice: Subject to any disclaimer, the term of this patent is extended or adjusted under 35 U.S.C. 154(b) by 0 days.

(21) Appl. No.: 16/243,608

(22) Filed: Jan. 9, 2019

(65) Prior Publication Data

US 2019/0209902 A1 Jul. 11, 2019

Related U.S. Application Data

(60) Provisional application No. 62/615,847, filed on Jan. 10, 2018.

(51) Int. Cl.

*A63B 53/00* (2015.01)
*A63B 53/04* (2015.01)
*A63B 102/32* (2015.01)

(52) U.S. Cl.

CPC .. *A63B 53/0487* (2013.01); *A63B 2053/0441* (2013.01); *A63B 2053/0445* (2013.01); *A63B 2102/32* (2015.10)

(58) Field of Classification Search

CPC ..... A63B 53/0487; A63B 2053/0441; A63B 2053/0445; A63B 2102/32

See application file for complete search history.

(56) References Cited

U.S. PATENT DOCUMENTS 1,485,272 A * 2/1924 Kinsman ..... A63B 69/3632 473/242
D205,041 S * 6/1966 Capps ..... D21/759
4,077,633 A * 3/1978 Studen ..... A63B 53/0487 473/251
4,659,083 A * 4/1987 Szczepanski ..... A63B 69/3685 473/252
4,819,943 A * 4/1989 Szczepanski ..... A63B 69/3685 473/252
5,354,059 A 10/1994 Stuff
5,676,603 A * 10/1997 Miller ..... A63B 69/3614 473/220
D405,137 S * 2/1999 Nelson ..... D21/738
5,984,800 A * 11/1999 Uebelhor ..... A63B 53/0487 473/251

(Continued)

FOREIGN PATENT DOCUMENTS

JP 9-262323 * 10/1997

*Primary Examiner* — Stephen L Blau

(74) *Attorney, Agent, or Firm* — Trenner Law Firm, LLC; Mark D. Trenner

(57) ABSTRACT

A golf putter is disclosed having a head having a forward face, a back face, a top surface, and a bottom surface, the top surface defining a leading edge of the head and a trailing edge of the head. A back flange extends rearward from the back face of the head. In an example, a plurality of angled alignment lines are formed in the top surface of the head. In an example, a first straight alignment line is formed in the top surface of the head, the straight alignment line is centered between the plurality of angled alignment lines. In an example, a second straight alignment line is aligned with the first straight alignment line. In an example, a plurality of grooves are formed in the forward face of the head.

19 Claims, 12 Drawing Sheets

(56) References Cited

U.S. PATENT DOCUMENTS

| | | | | |
|---|---|---|---|---|
| D431,853 | S | 10/2000 | Antonious | |
| 6,224,497 | B1 | 5/2001 | Antonious | |
| 6,244,974 | B1 * | 6/2001 | Hanberry, Jr. ..... | A63B 53/007 473/242 |
| 6,309,310 | B1 | 10/2001 | Shira | |
| 6,409,610 | B1 * | 6/2002 | Ahn ..... | A63B 53/0487 473/249 |
| D483,825 | S * | 12/2003 | Green ..... | D21/744 |
| D533,613 | S | 12/2006 | Byrne et al. | |
| 7,452,283 | B2 | 11/2008 | Hettinger et al. | |
| 7,540,810 | B2 | 6/2009 | Hettinger et al. | |
| 8,636,607 | B2 * | 1/2014 | Renna ..... | A63B 53/0487 473/340 |
| 2009/0156328 | A1 | 6/2009 | Reese | |
| 2014/0018180 | A1 * | 1/2014 | Wong ..... | A63B 53/0466 473/254 |

* cited by examiner

GOLF PUTTER

CROSS REFERENCE TO RELATED APPLICATIONS

This application claims the priority benefit of U.S. Provisional Patent Application No. 62/615,847 filed Jan. 10, 2018 for "Golf Putter" of Matthew Stephens, hereby incorporated by reference in its entirety as though fully set forth herein.

BACKGROUND

A wide variety of golf putters are available to address a variety of aspects to help improve putting and aligning the putter during putting.

Golf putters are available that address alignment issues by providing the putter head with graphics such as lines, dots, golf ball sized circles and other shapes for the user to look at as guides.

Golf putters are also available that address line angle with a notch at the top line of a putter. When the horizontal line on the flange sits inside the notch, the user is over the ball.

Golf putters are also available that address dispersion on off-center hits. One way to help decrease dispersion on off-center hits is to increase the Moment Of Inertia (MOI) of the putter head. To accomplish this, the putter usually includes a very large head with added weight in the rear of the putter. This method is effective but the putter is usually not very pleasing to the eye of the golfer (it is considered ugly by golfers).

Others have tried to correct this problem while keeping a traditional head design by adding horizontal lines that vary in width so the energy transfer is variable. End-users have also added inserts to the face of the putter that vary in firmness in an effort to limit dispersion.

DETAILED DESCRIPTION

A golf putter is disclosed which addresses several problems most golfers have. Alignment of the putter is very important and many golfers have issues with their aim. The golf putter disclosed herein has angled grooves (alignment lines) to the top line of the leading edge of the putter. These grooves (or alignment lines) help create a visual "tracking line" for the golfer so that they can see where they are aiming. These grooves also provide the golfer with a reference point of the sweet spot.

The ideal position for putting is to have your eyes directly over the golf ball. The golf putter disclosed herein has a straight line (in the center of the angled lines) on the leading edge of the putter and on the back flange. When the user looks down and the two lines are connected, the user knows their eyes are directly over the ball and the sweet spot of the putter. The two lines and the angled grooves provide a similar effect to looking through a sight on a rifle.

The face of the golf putter disclosed herein also has different sets of grooves. The center set of grooves is horizontal. These help the golf ball get rolling toward its target and reduce or altogether prevent the ball from bouncing. The angled grooves on the toe and the heel of the putter help to reduce the amount of dispersion on putts that are mishit.

Before continuing, it is noted that as used herein, the terms "includes" and "including" mean, but is not limited to, "includes" or "including" and "includes at least" or "including at least." The term "based on" means "based on" and "based at least in part on."

It is also noted that the examples described herein are provided for purposes of illustration, and are not intended to be limiting. Other devices and/or device configurations may be utilized to carry out the operations described herein. It is noted that other designs of the golf putter and head may also be provided which implement some or all of the aspects shown and described herein.

Figure 1:
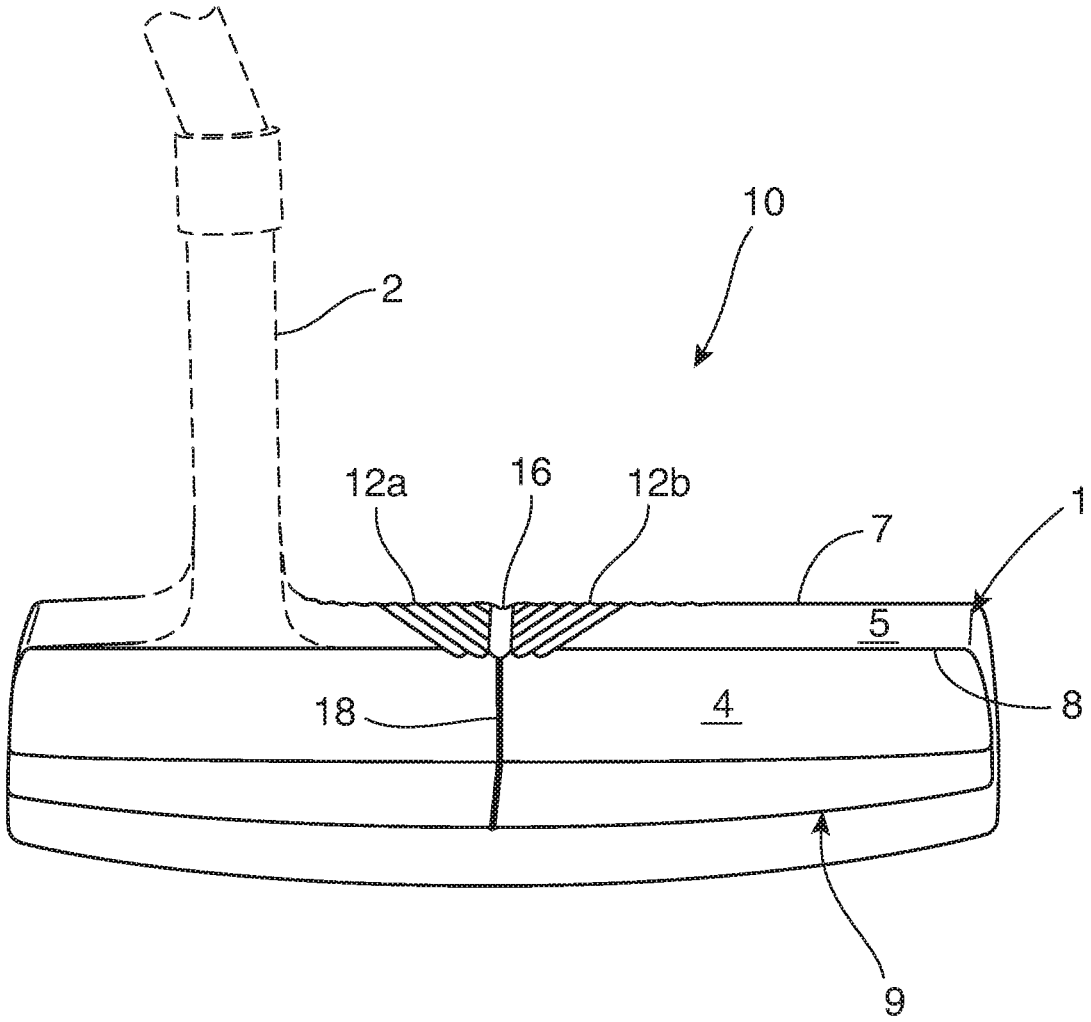
FIG. 1 is a perspective view of an example golf putter with alignment lines.

FIG. 1 is a perspective view of an example golf putter 10 with alignment lines. In FIG. 1, a portion of the shaft 1 is shown in dashed lines and the head 2 is shown in solid lines. The dashed lines are shown to focus the reader's attention on the head 2. Any suitable shaft 1 may be provided. It is also noted that the alignment lines and grooves disclosed herein may also be provided with different size and/or shape heads 2.

Figure 2:
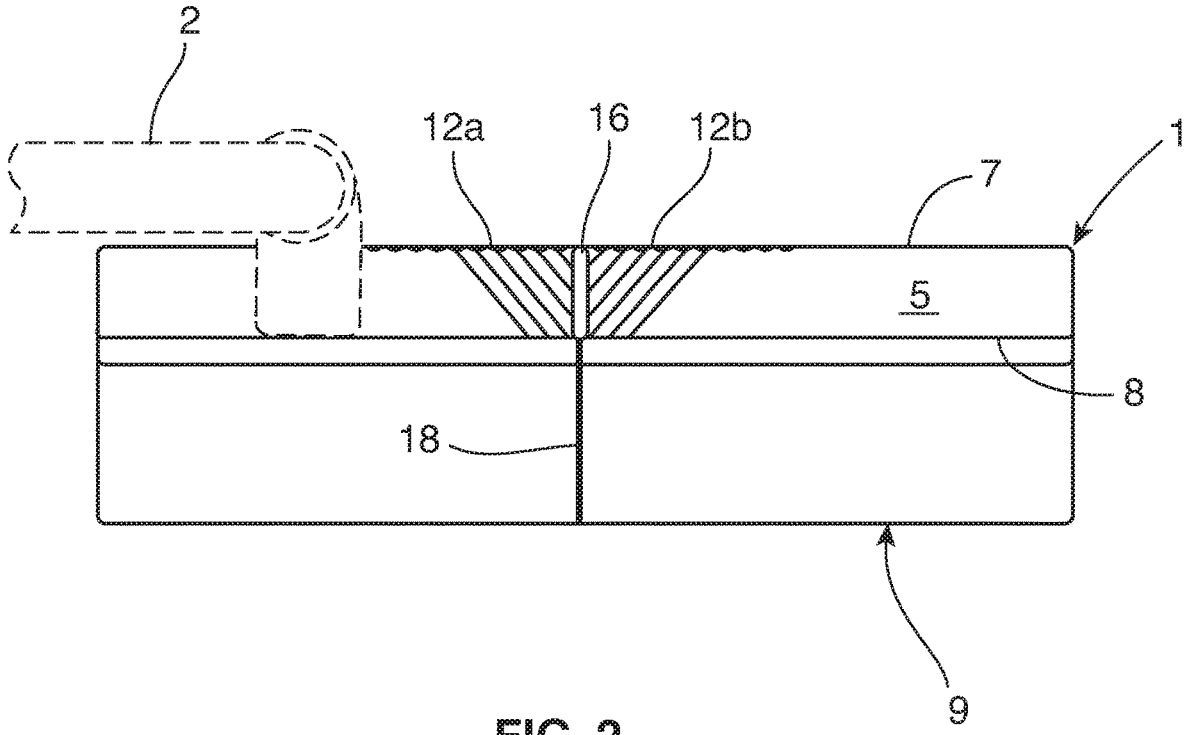
FIG. 2 is a top view of the example golf putter shown in FIG. 1.
Figure 3:
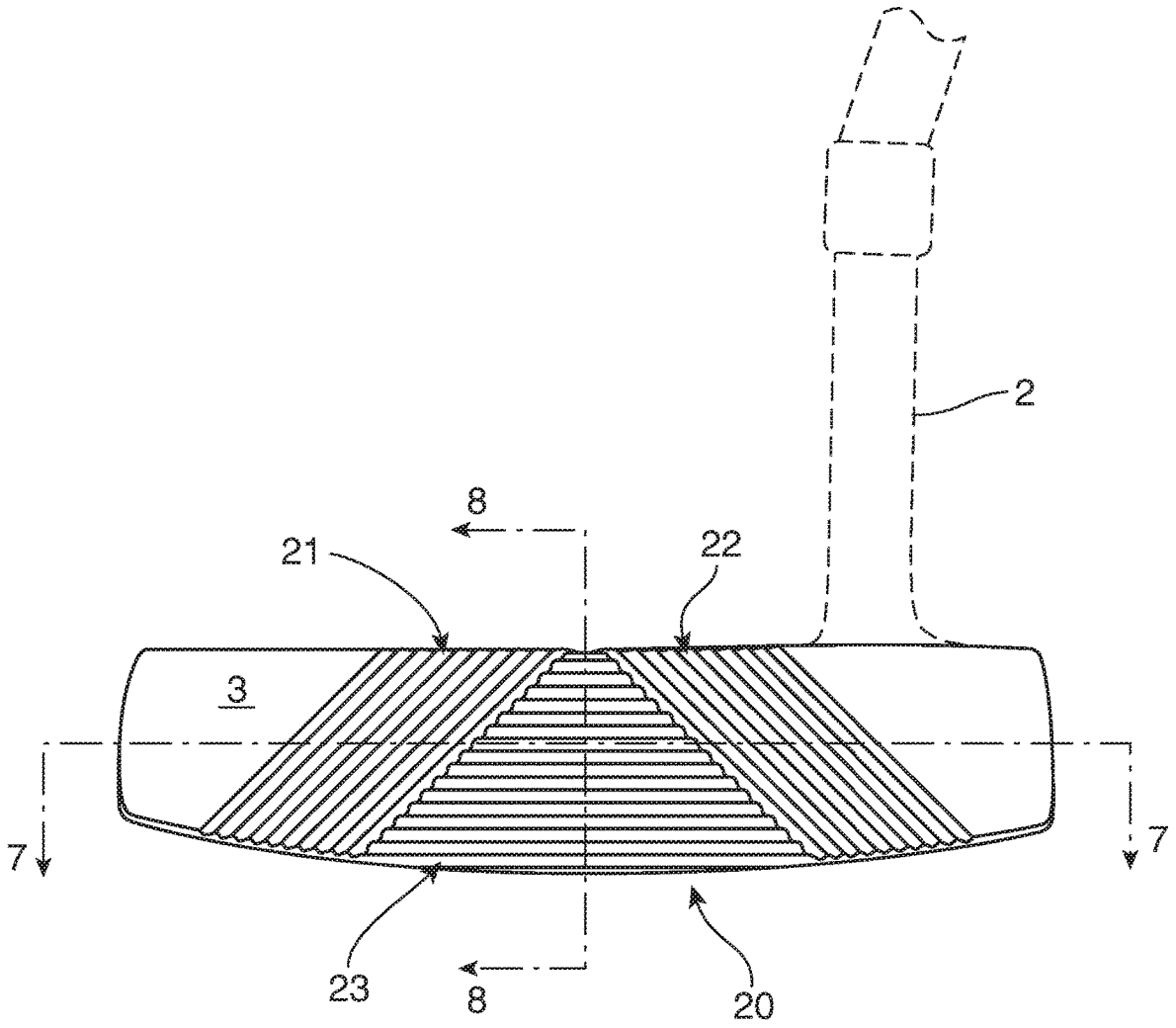
FIG. 3 is a front view of the example golf putter shown in FIG. 1.
Figure 4:
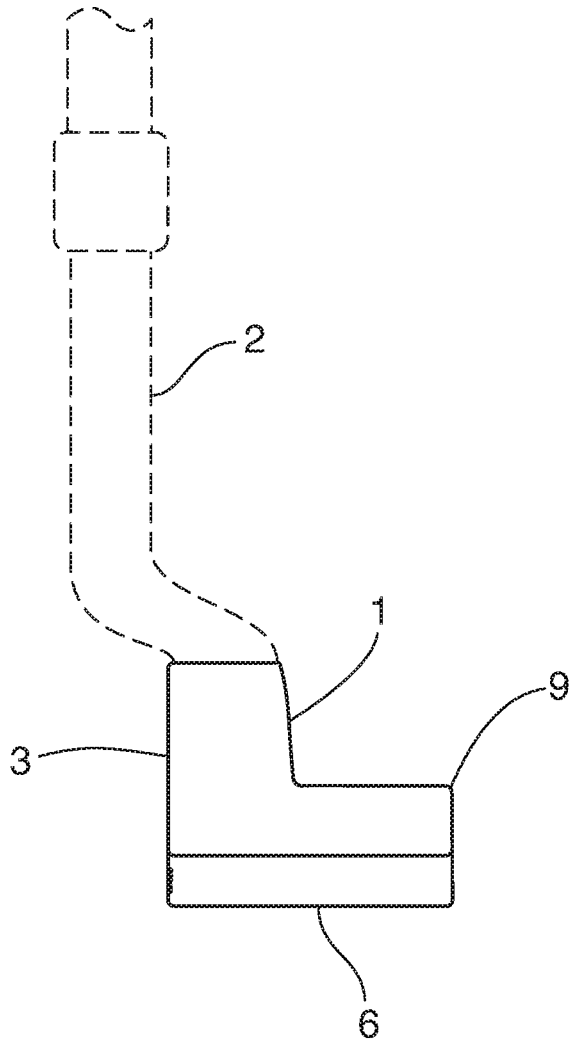
FIGS. 4-5 are side views of the example golf putter shown in FIG. 1.
Figure 5:
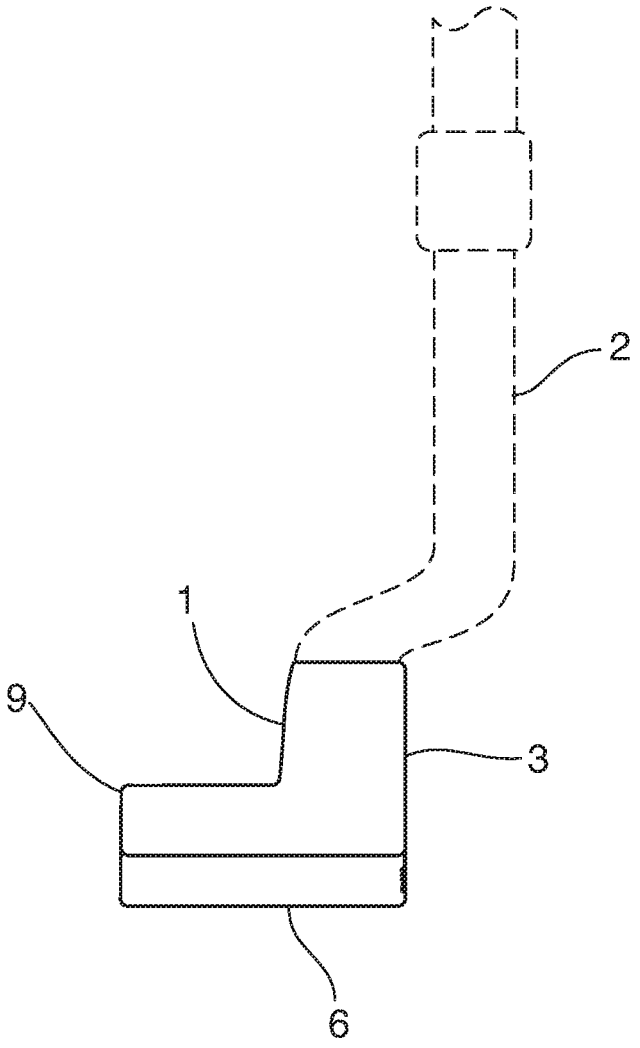
Figure 6:
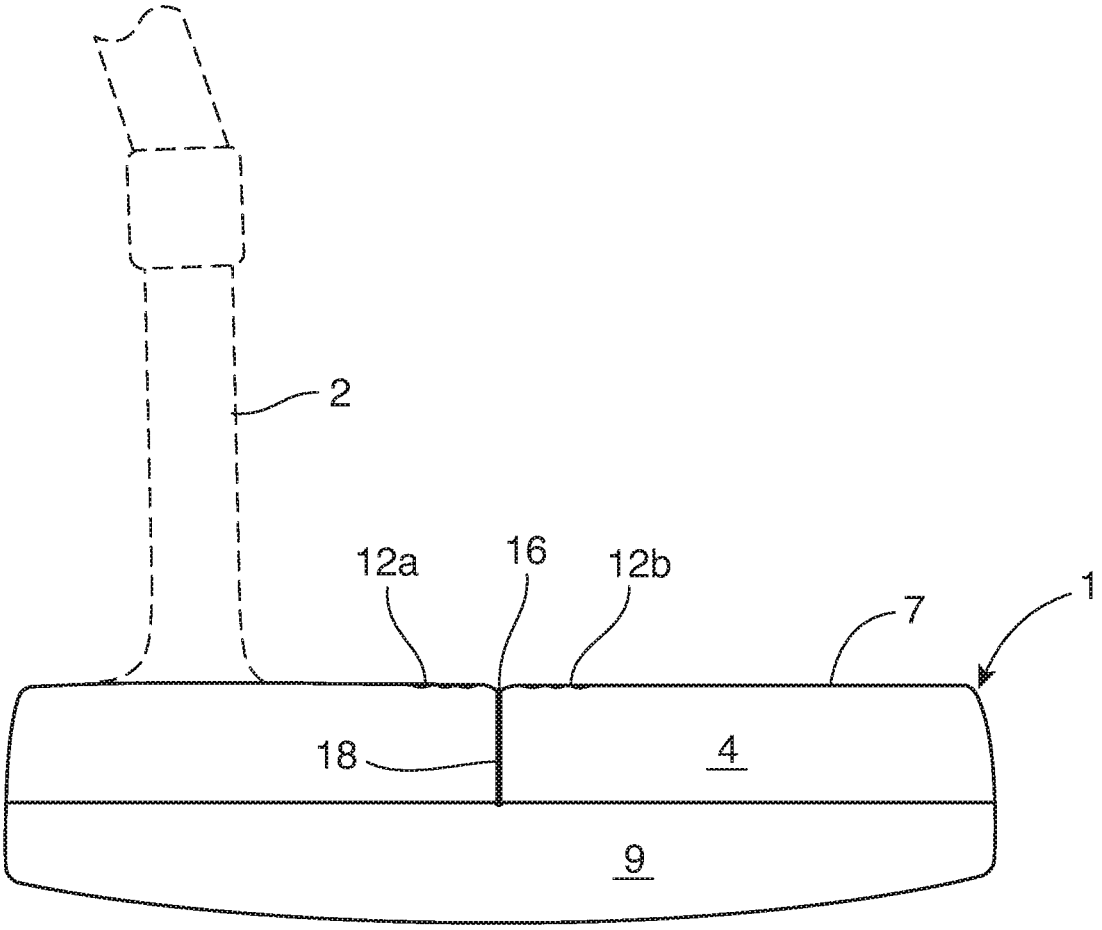
FIG. 6 is a rear view of the example golf putter shown in FIG. 1.
Figure 7:
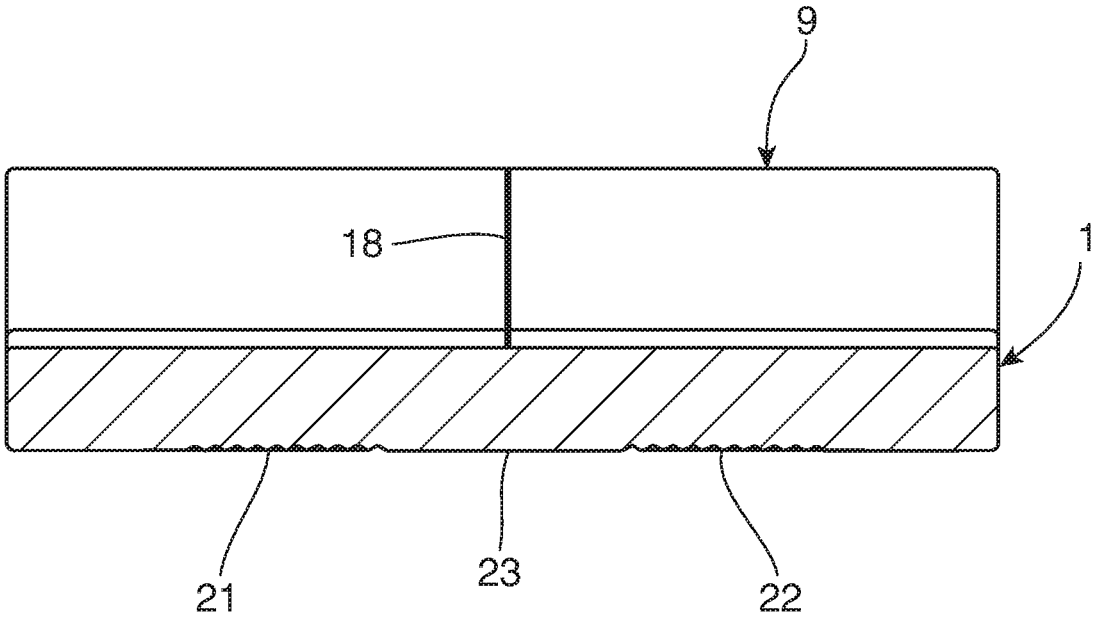
FIG. 7 is a cross sectional view of the example golf putter taken along lines 7-7 in FIG. 3.
Figure 8:
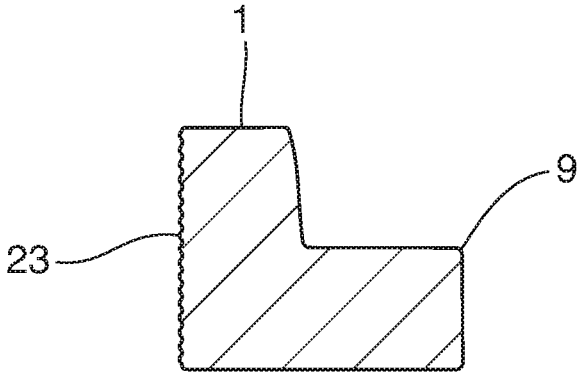
FIG. 8 is a cross sectional view of the example golf putter taken along lines 8-8 in FIG. 3.

FIG. 2 is a top view of the example golf putter 10 shown in FIG. 1. FIG. 3 is a front view of the example golf putter 10 shown in FIG. 1. FIGS. 4-5 are side views of the example golf putter 10 shown in FIG. 1. FIG. 6 is a rear view of the example golf putter 10 shown in FIG. 1.

An example of the golf putter 10 includes the head 2 having a forward face 3, a back face 4, a top surface 5, and a bottom surface 6. The top surface 5 defines a leading edge 7 of the head 2 and a trailing edge 8 of the head 2. A back flange 9 extending rearward from the back face 4 of the head 2.

The back flange 9 is shown as being substantially curved in shape. However, any shape back flange may be provided. Again, it will be readily understood that the head 1 (including back flange 9) may be any suitable size, shape, weight, color, and/or other configuration. The disclosure herein is not limited to any particular type or style of head 1 and/or back flange 9.

An example of the golf putter 10 includes a plurality of angled alignment lines 12*a* and 12*b* formed on the top surface 5 of the head 1. In an example, the plurality of angled alignment lines include a first set of angled alignment lines 12*a* positioned at about 45 degrees (relative to the leading edge 7) and extending from the leading edge 7 to the trailing edge 8 of the top surface 5 of the head 1. The plurality of angled alignment lines also include a second set of angled alignment lines 12*b* positioned at about 45 degrees (relative to the leading edge 7) and extending from the leading edge 7 to the trailing edge 8 of the top surface 5 of the head 1. In an example, the first set and the second set of angled alignment lines 12*a* and 12*b* are at opposite angles relative to one another. That is, the sets of angled alignment lines 12*a* and 12*b* are angled toward each other at the trailing edge 8 to form an "arrowhead", V-shape, or point.

When so positioned, the angled alignment lines form a visual tracking line or patter of lines (see, e.g., tracking pattern 14 in FIG. 12) when viewed top-down during a golf swing. Of course, the alignment lines may be provided at other angles based on various design considerations, e.g., to provide different tracking patterns. In still other examples, the alignment lines may be other shapes (e.g., curved).

A first straight alignment line 16 is also provided on the top surface 5 of the head 1. In an example, the first straight alignment line 16 is formed as a groove or cutout in the top surface 5 of the head 1. A second straight alignment line 18 may be provided adjacent (e.g., touching or "connected") to the first straight alignment line 16.

In an example, the first straight alignment line 16 is substantially centered between the sets of angled alignment lines 12*a* and 12*b*. The first straight alignment line 16 extends from the leading edge 7 to the trailing edge 8 of the top surface 5 of the head 1. The second straight alignment line 18 extends down the back face 4 of the head 1 and across a top of the back flange 9.

In an example, the first straight alignment line 16 and the second straight alignment line 18 appear to be visually aligned when viewed top-down directly over center of the head. See, for example, illustration B in FIG. 13. If the golfer's stance is off alignment, then the first straight alignment line and the second straight alignment line appear to be visually aligned. See, for example, illustrations A and C in FIG. 13.

In an example, the golf putter 10 also includes a plurality of grooves 20 on the forward face 3 of the head 1. The grooves are formed in the head itself. In an example, the grooves are formed in or cut in the head 1. In an example, the grooves are substantially v-shaped formations (or cutouts) within the head 1, as can be seen for example, in FIGS. 1-3 and 6-8. However, the grooves may be rounded (e.g., semi-circle) in shape. Indeed, the formations may be provided on a flat surface of the head 1 and do not need to be cut from or formed within the head 1.

The plurality of grooves 20 of the head 1 include a first set of grooves 21 extending at about 45 degrees from a bottom edge of the forward face 3, to a top edge of the forward face 3 of the head 1. A second set of grooves 22 extend at about 45 degrees from the bottom edge of the forward face 3 to the top edge of the forward face 3 of the head 1.

In an example, the first set 21 and the second set 22 of grooves are at opposite angles relative to one another. That is, the first set of grooves 21 and the second set of grooves 22 form a V-shape or point. It is noted that other arrangements and configurations of the grooves may also be provided, based on various design considerations.

The angled grooves 22 in the heel side of the head 1 prevent dispersion from putts that are mishit on the heel side. The angled grooves 21 in the toe side of the head prevent dispersion from putts that are mishit on the toe side.

Between the first and second set of grooves is a horizontal set of grooves 23. The horizontal grooves 23 aid in providing forward motion to a golf ball when the golf ball is hit, without any bounce in the golf ball.

The example golf putter 10 resolves several problems most golfers have. First, alignment of the putter during putting is very important and many golfers have issues with their aim. The example golf putter 10 has angled grooves. The grooves help create a visual "tracking line" for the golfer so they can see the where they are aiming. These angled lines also provide the golfer with a reference point of the sweet spot.

The ideal position for putting is to have your eyes directly over the golf ball. The golf putter 10 also includes alignment lines (in the center of the angled lines) on the leading edge of the putter and on the back flange. When the user looks down and the two lines are visually aligned, the user knows their eyes are directly over the ball and the sweet spot of the putter. The two lines and the angled grooves provide a similar effect to looking through a sight on a rifle.

In an example, the forward face of the example golf putter includes several (e.g., three) different sets of grooves. In an example, the center set of grooves is horizontal. These grooves help the golf ball get rolling toward its target and don't allow the ball to bounce much. The angled grooves on the toe and the heel of the putter are intended to reduce the amount of dispersion on putts that are mishit. These and other aspects will become apparent with reference to the illustrations shown in FIGS. 9-13 and described below.

FIGS. 9-13 illustrate example operations of the golf putter shown in FIG. 1. The operations shown and described herein are provided to illustrate example implementations. It is noted that the operations are not limited to the ordering shown. Still other operations may also be implemented as will become apparent to those having ordinary skill in the art after becoming familiar with the teachings herein.

Figure 9:
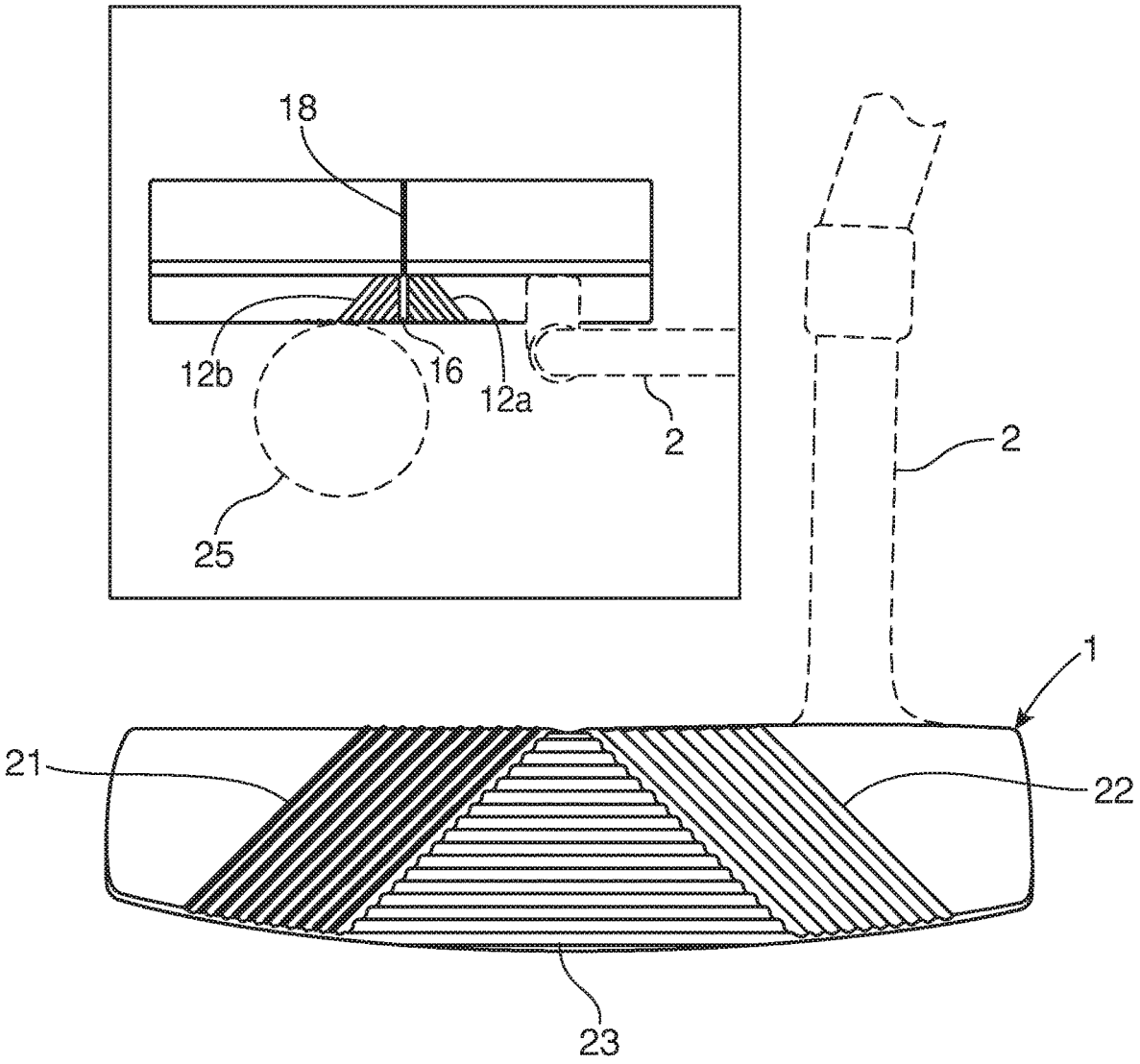
FIGS. 9-13 illustrate example operations of the golf putter shown in FIG. 1.

FIG. 9 illustrates the example golf putter described herein as it may be implemented during a swing to address a golf term known as "Toe Milling." In this example, the forward face of the golf putter 10 is illustrated along with a top view (shown in the box). When a ball (illustrated by outline 25) is hit off the toe of the golf putter disclosed herein, the grooves 21-23 in the forward face reduce or altogether eliminate dispersion that would otherwise occur due to an off-center hit. Balls can also be hit from this location on the forward face to reduce the break on left-to-right putts.

Figure 10:
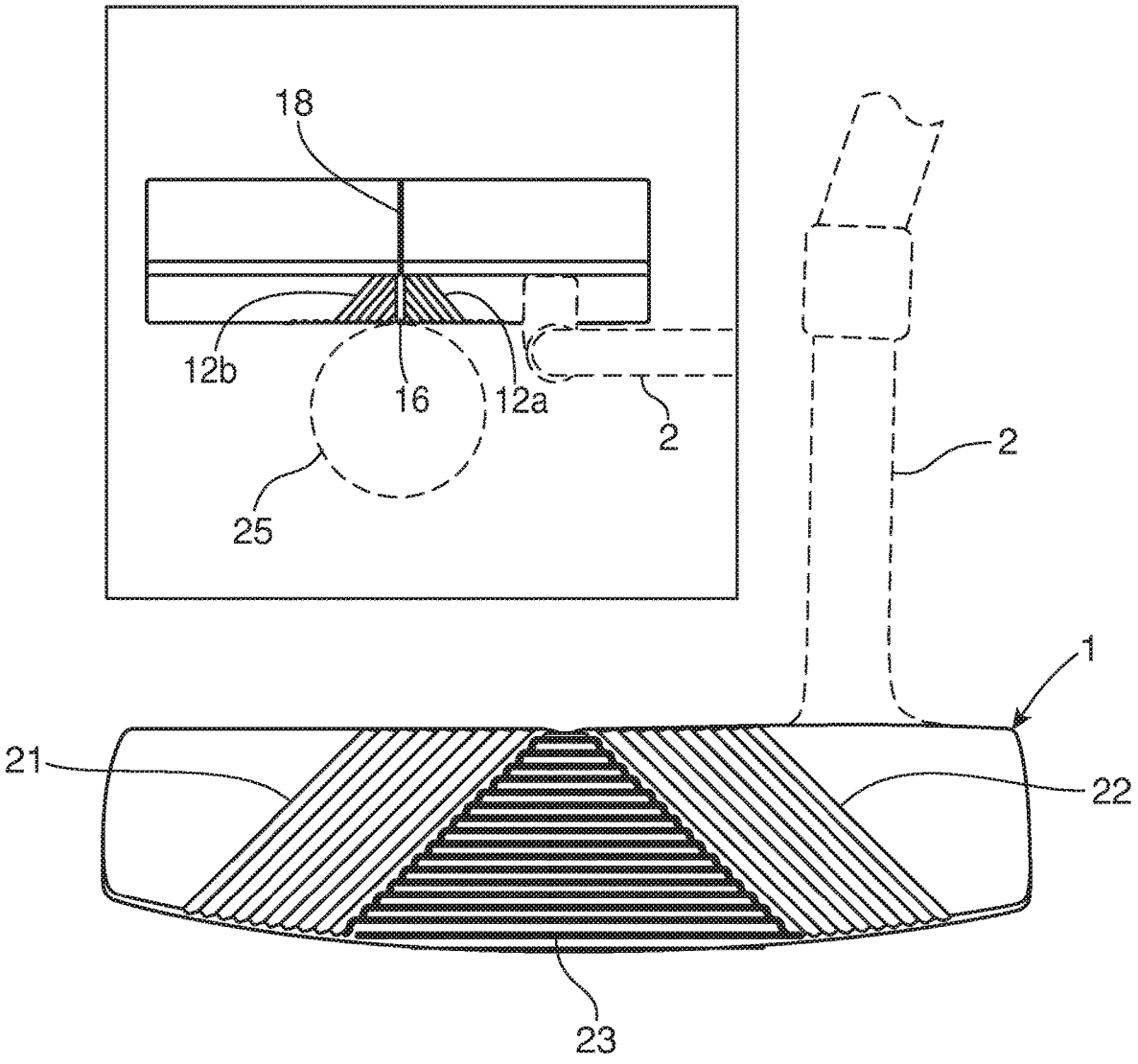

FIG. 10 illustrates the example golf putter described herein as it may be implemented during a swing to address a golf term known as "Sweet Spot Milling." In this example, the forward face of the golf putter 10 is illustrated along with a top view (shown in the box). When a ball (illustrated by outline 25) is hit in the sweet spot of the golf putter disclosed herein, the horizontal grooves provide the ball with top spin, helping prevent the ball from skidding or bouncing off line while keeping the ball tracking towards the hole.

Figure 11:
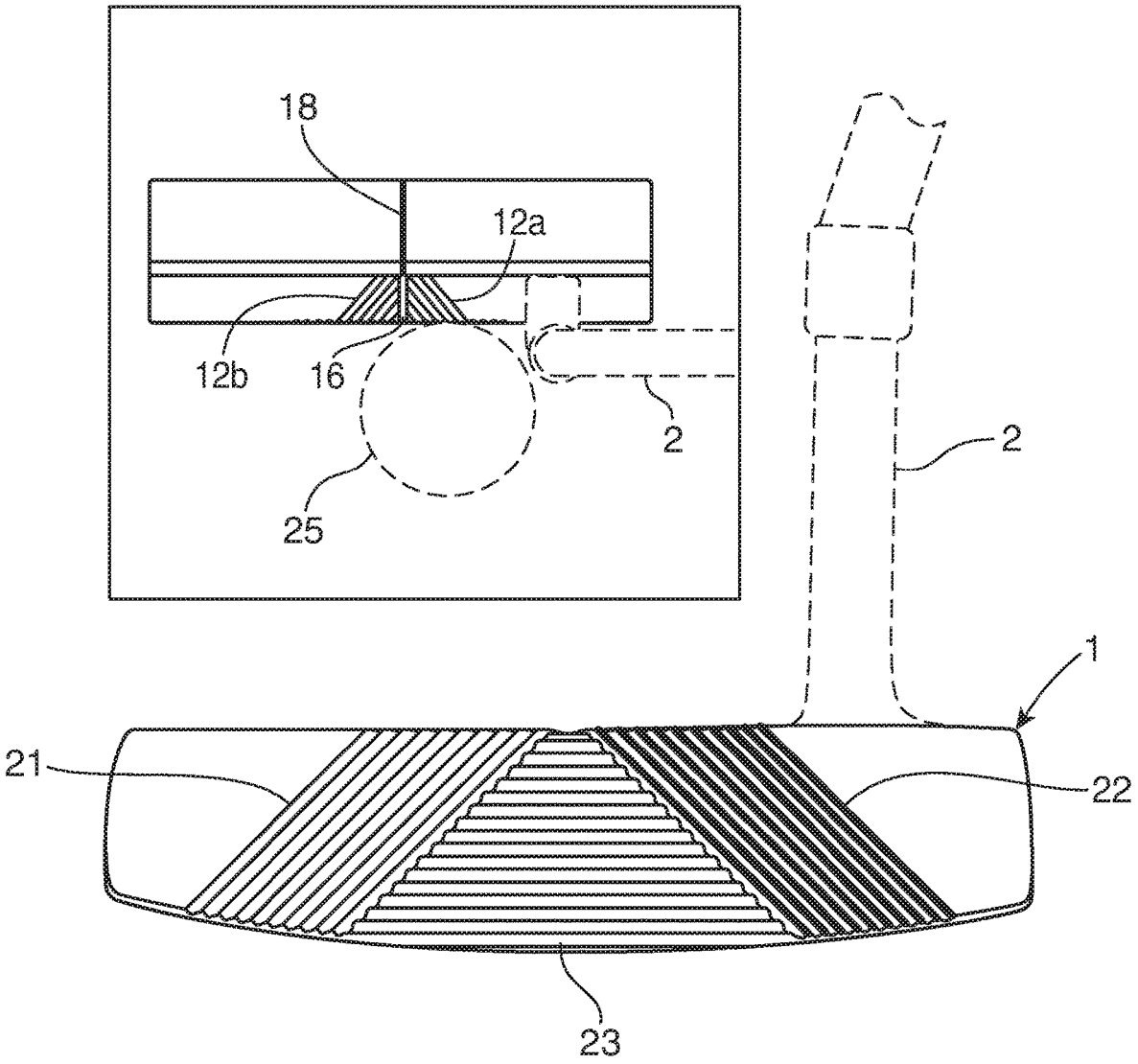

FIG. 11 illustrates the example golf putter described herein as it may be implemented during a swing to address a golf term known as "Heel Milling." In this example, the forward face of the golf putter 10 is illustrated along with a top view (shown in the box). When a ball (illustrated by outline 25) is hit off the heel of the golf putter disclosed herein, the grooved face reduces the dispersion of the off-center hit. Balls can also be hit from this location on the face to reduce the break on right-to-left putts.

Figure 12:
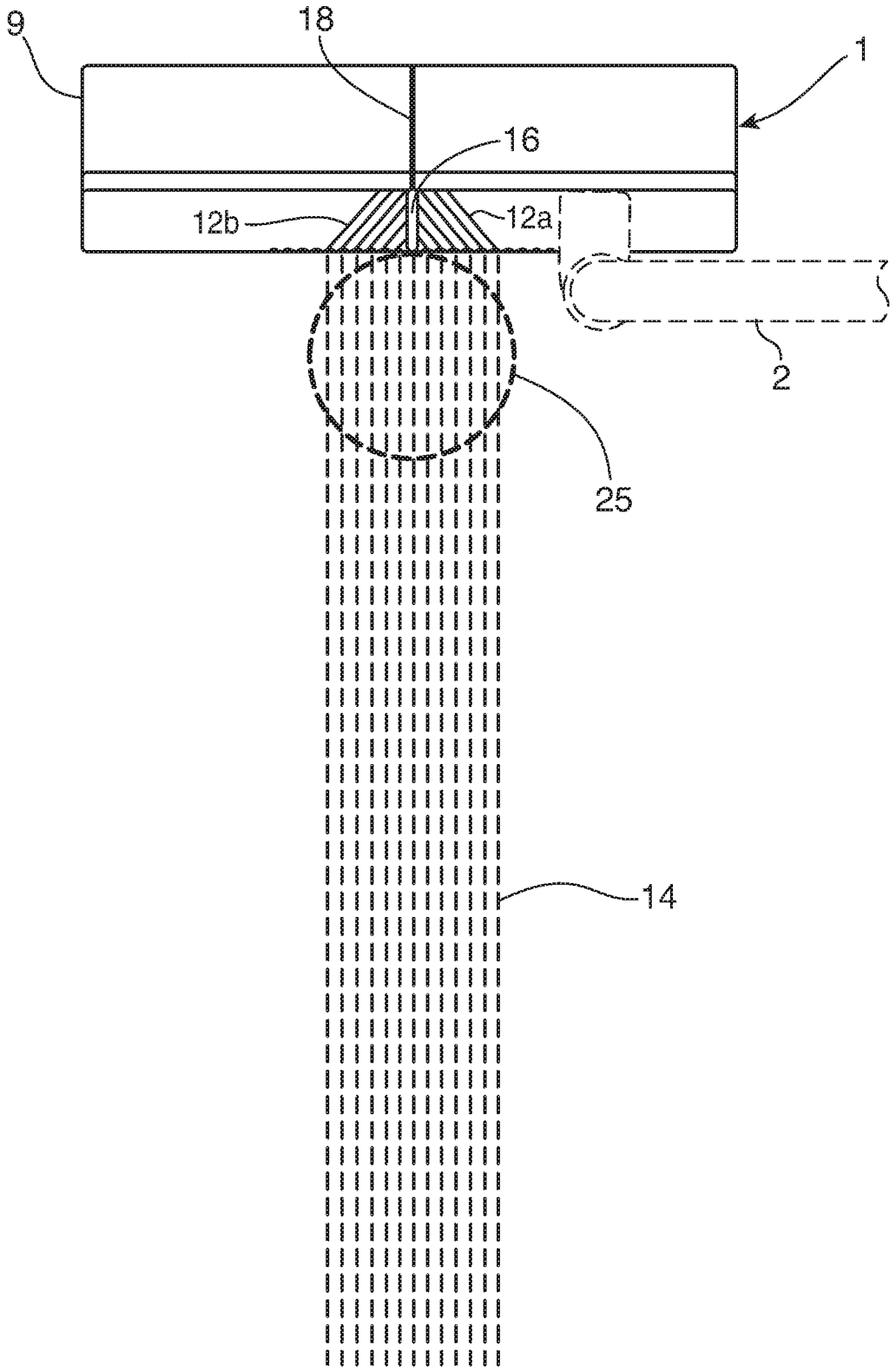

FIG. 12 illustrates the example golf putter described herein as it may be implemented during a swing to address swing alignment. The grooves on the leading edge of the golf putter disclosed herein help center the ball in the sweet spot. These grooves also create a visual tracking line to the intended target.

Figure 13:
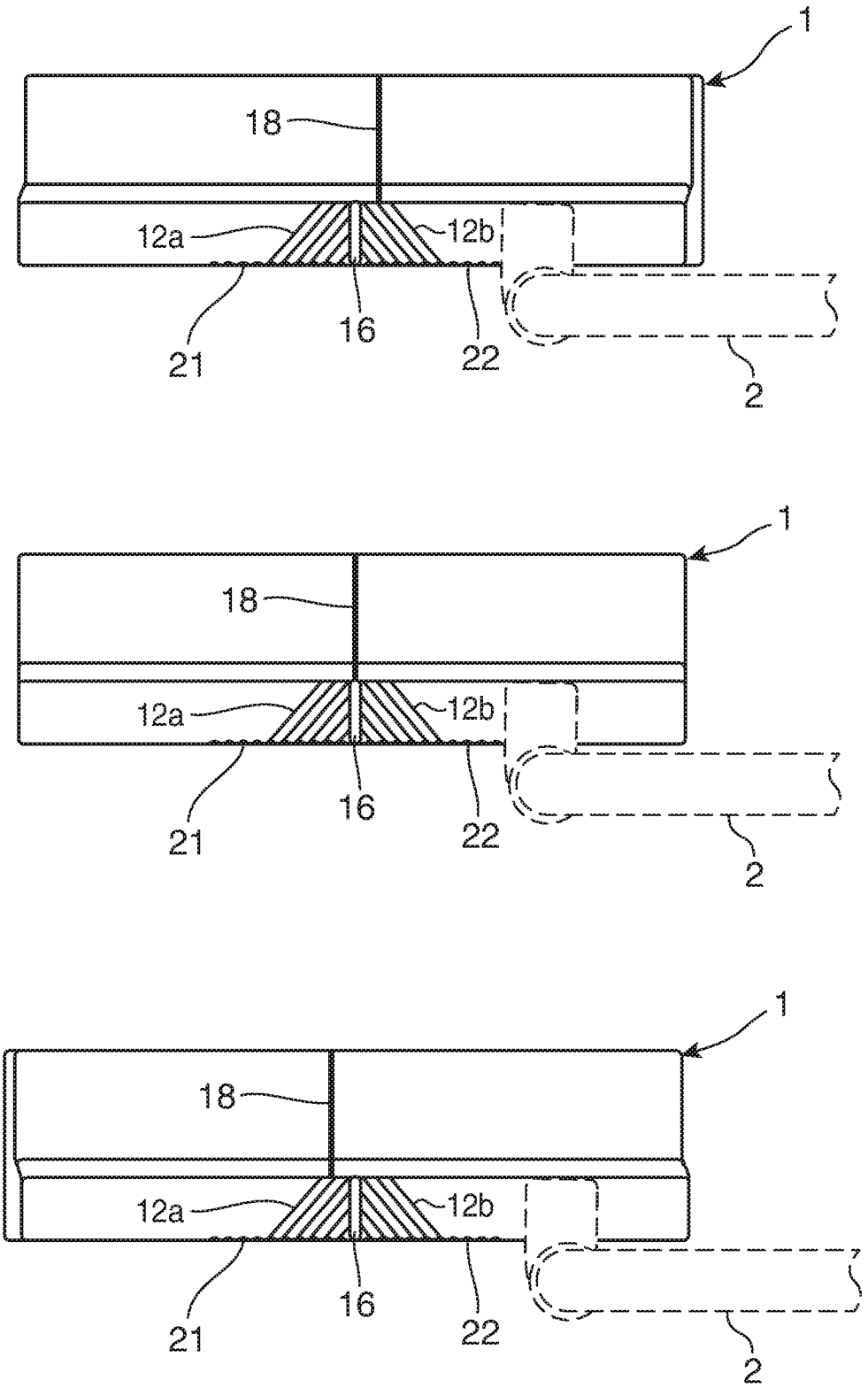

FIG. 13 illustrates visual lie angle. It can be seen in this illustration that the first and second straight alignment lines operate in conjunction with one another to provide a visual alignment when viewed from above. At (A) in FIG. 13, the user's eyes are above the target line or "toes up." The golfer can correct this stance by shifting to the right. At (B) in FIG.

13, the user's eyes are just right of center, and indicates a preferred stance for a golf putt. At (C) in FIG. 13, the user's eyes are below the target line or "toe down." The golfer can correct this stance by shifting to the right.

It is noted that the examples shown and described are provided for purposes of illustration and are not intended to be limiting. Still other examples are also contemplated.

The invention claimed is:

1. A golf putter comprising:

a head having a forward face, a back face, a top surface, and a bottom surface, the top surface defining a leading edge of the head and a trailing edge;

a back flange extending rearward from the back face of the head;

a plurality of angled alignment lines formed on the top surface of the head wherein the angled alignment lines are angled relative to both the leading edge of the top surface and a perpendicular direction from the leading edge of the top surface, and wherein the angled alignment lines are spaced from both sides of the head between the leading edge and the trailing edge of the top surface;

a straight first alignment line on the top surface of the head wherein the straight first alignment line extends from the leading edge to the trailing edge of the top surface of the head;

alignment line extending below and connected to the straight first line; and a plurality of grooves formed on the forward face of the head.

2. The golf putter of claim 1, wherein the plurality of grooves formed on the forward face of the head include a plurality of horizontal grooves formed in the forward face of the head.

3. The golf putter of claim 2, wherein the horizontal grooves provide forward motion to a golf ball when the golf ball is hit without any bounce in the golf ball.

4. The golf putter of claim 1, wherein the plurality of grooves formed on the forward face of the head include a plurality of angled grooves formed in a heel side of the forward face of the head.

5. The golf putter of claim 4, wherein angled grooves in the heel side of the head prevent dispersion from putts that are mishit on the heel side.

6. The golf putter of claim 1, wherein the plurality of grooves formed on the forward face of the head include a plurality of angled grooves formed in a toe side of the forward face of the head.

7. The golf putter of claim 6, wherein angled grooves in the toe side of the head prevent dispersion from putts that are mishit on the toe side.

8. The golf putter of claim 1, wherein the angled alignment lines and straight first alignment line form a visual tracking line when viewed top-down during a golf swing.

9. The golf putter of claim 1, wherein the straight first alignment line and the second alignment line appear visually aligned when viewed top-down directly over center of the head.

10. The golf putter of claim 1, wherein the plurality of angled alignment lines on the top surface of the head extend from the leading edge of the top surface to the trailing edge of the top surface.

11. The golf putter of claim 1, wherein the straight first alignment line is substantially centered between the plurality of angled alignment lines.

12. The golf putter of claim 1, wherein the second alignment line extends down the back face of the head and across a top of the back flange.

13. The golf putter of claim 1, where the plurality of angled alignment lines include a first set of angled alignment lines extending at about 45 degrees from the leading edge to the trailing edge of the top surface of the head.

14. The golf putter of claim 13, wherein the plurality of angled alignment lines include a second set of angled alignment lines extending at about 45 degrees from the leading edge to the trailing edge of the top surface of the head, wherein the first set and the second set of angled alignment lines are at opposite angles relative to one another.

15. The golf putter of claim 1, wherein the plurality of grooves on the forward face of the head include a first set of grooves extending at about 45 degrees from a bottom edge of the forward face to a top edge of the forward face of the head.

16. The golf putter of claim 15, wherein the plurality of angled alignment lines include a second set of grooves extending at about 45 degrees from the bottom edge of the forward face to the top edge of the forward face of the head, wherein the first set and the second set of grooves are at opposite angles relative to one another.

17. A golf putter comprising:

a head having a forward face, a back face, a top surface, and a bottom surface, the top surface defining a leading edge of the head and a trailing edge;

a back flange extending rearward from the back face of the head;

a plurality of angled alignment grooves formed in the top surface of the head, the plurality of angled alignment grooves extending from the leading edge of the top surface to the trailing edge of the top surface, wherein the angled alignment grooves are angled relative to both the leading edge of the top surface and a perpendicular direction from the leading edge of the top surface, and wherein the angled alignment grooves are spaced from both sides of the head between the leading edge and the trailing edge of the top surface;

a straight first alignment groove formed in the top surface of the head, the straight first alignment groove centered between the plurality of angled alignment grooves, the straight first alignment groove extending from the leading edge to the trailing edge of the top surface of the head;

a second alignment line aligned with the straight first alignment groove and extending down the back face of the head and across a top of the back flange;

a plurality of grooves formed on the forward face of the head.

18. The golf putter of claim 17, wherein the plurality of grooves formed on the forward face of the head include a plurality of horizontal grooves, a plurality of angled grooves on a heel side of the forward face of the head, and a plurality of angled grooves on a toe side of the forward face.

19. A golf putter comprising:

a head having a forward face, a back face, a top surface, and a bottom surface, the top surface defining a leading edge of the head and a trailing edge of the head;

a back flange extending rearward from the back face of the head;

a plurality of angled alignment lines formed in the top surface of the head, the plurality of angled alignment lines extending from the leading edge of the top surface to the trailing edge of the top surface, wherein the angled alignment lines are angled relative to both the leading edge of the top surface and a perpendicular direction from the leading edge of the top surface, and wherein the angled alignment lines are spaced from both sides of the head between the leading edge and the trailing edge of the top surface;

a straight first alignment line formed in the top surface of the head, the straight first alignment line centered between the plurality of angled alignment lines, the straight first alignment line extends from the leading edge to the trailing edge of the top surface of the head;

a second alignment line aligned with the straight first alignment line, the second alignment line extends down the back face of the head and across a top of the back flange;

a plurality of horizontal grooves formed in the forward face of the head;

a plurality of angled grooves formed in a heel side of the forward face of the head; and a plurality of angled grooves formed in a toe side of the forward face of the head.

* * * * *